United States Patent [19]

Beacham

[11] 4,248,056

[45] Feb. 3, 1981

[54] HEAT RECLAIMER FOR A HEAT PUMP

[75] Inventor: William H. Beacham, Putnam, Canada

[73] Assignee: 379235 Ontario Ltd., Putnam, Canada

[21] Appl. No.: 38,126

[22] Filed: May 11, 1979

[51] Int. Cl.[3] ..... F25B 27/02; F25B 13/00

[52] U.S. Cl. ..... 62/238 E; 62/324 D

[58] Field of Search ..... 62/238 E, 324 D

[56] References Cited

U.S. PATENT DOCUMENTS

| | | | |
|---|---|---|---|
| 2,125,842 | 8/1938 | Eggleston | 62/238 E |
| 2,375,157 | 5/1945 | Wilkes et al. | 62/238 E |
| 4,091,994 | 5/1978 | Madsen | 62/238 E |
| 4,141,222 | 2/1979 | Ritchie | 62/238 E |
| 4,142,379 | 3/1979 | Kuklinski | 62/238 E |

*Primary Examiner*—Lloyd L. King

[57] ABSTRACT

This invention relates to a heat reclaiming device for a heat pump. The heat reclaimer is able to absorb heat from the compressor by circulating cooling fluid through a circuit which is mounted in good heat transfer relationship with the condenser, then around the shell of the motor-compressor and lastly around the hollow tube which connects the condenser to the compressor. The reclaiming circuit is connected into a fluid circulating loop which is used to supply heat to the evaporator coil of the heat pump.

1 Claim, 2 Drawing Figures

HEAT RECLAIMER FOR A HEAT PUMP

BACKGROUND OF THE INVENTION

Because of the variations in the weather conditions in the North American continent, in certain areas where the winter temperatures are particularly severe, the governing factor controlling the design capacity of the heat pump installation must be based on the ability to pump heat from the exterior to the interior of a building. It is in this type of installation that this invention is directed.

In installations of the above type, it is desirable to pump the maximum heat possible into the condenser coils of the installation. Prior art installations have merely chosen to ignore the heat generated in the motor-compressor, and the waste heat generated by the motor-compressor has been allowed to escape in any manner from the compressor to the surrounding air.

SUMMARY OF THE INVENTION

This invention seeks to collect the heat given off by the motor-compressor and channel it to the condenser where it will be released to heat the area in the region of the condenser. Briefly, the heat pump of this invention is able to permit the capture of the heat which would in prior art compressors escape to the surrounding medium by a reclaiming circuit which is in intimate contact with the condenser coil, the motor-compressor shell, and the connecting tubing joining the condenser and the compressor shell.

Because the evaporator is heated by an auxiliary heating circuit which may deliver heated fluid which may be collected from an auxiliary source of heat, such as solar panels or a hot water storage etc., it is possible to connect a heat reclaiming circuit in parallel with the auxiliary circuit and circulate a portion of the fluid which is being pumped toward the evaporator in the auxiliary circuit. The reclaiming circuit gathers heat from the parts of the heat pump with which it is in intimate contact and delivers the heat to the evaporator. The evaporator thus has the bulk of the heat given off by the compressor reintroduced into the evaporator so that the heat pump may again move the heat from the evaporator to the condenser. The reclaiming circuit permits the delivery of the waste heat given off by the compressor to the condenser coils and in so doing increases the C.O.P. of the heat pump installation.

This invention is especially important in heat pump installations where it is desired to maximize the heat flow in one of the directions that the heat pump must operate, and the circuit provides an additional bonus in installations where the heat pump is used to heat a building but the actual location of the heat pump is not in the building it is heating.

DESCRIPTION OF THE PREFERRED EMBODIMENT

Figure 1:
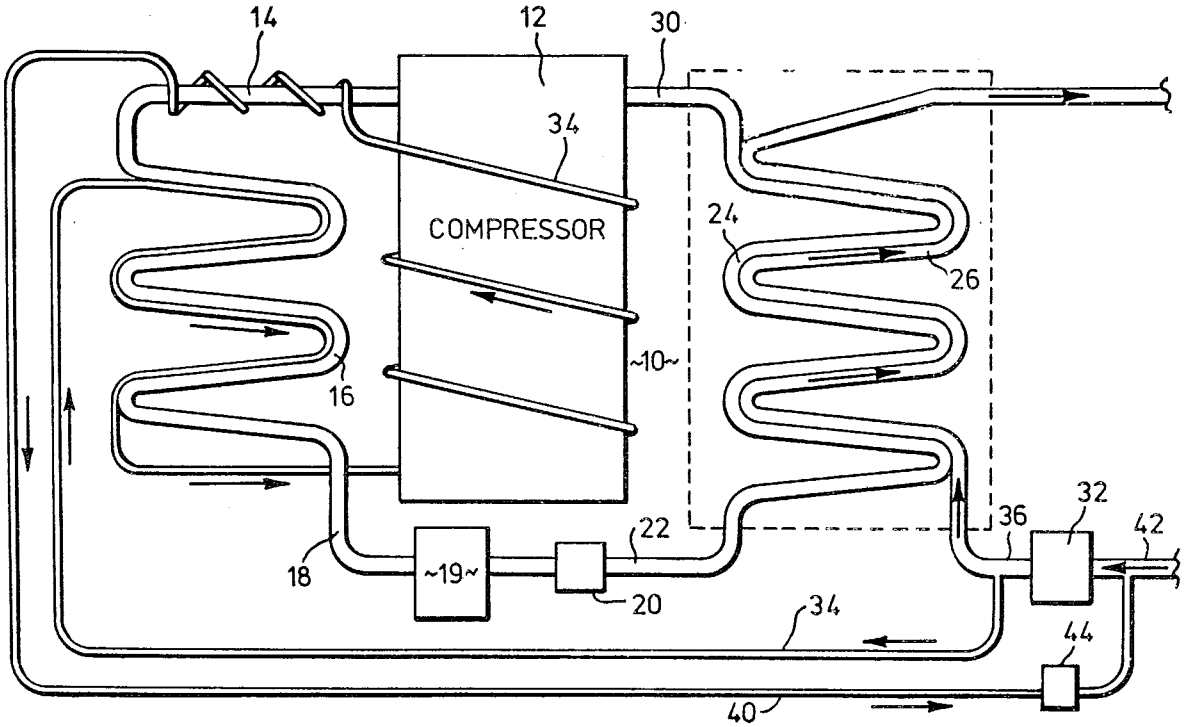
FIG. 1 shows a diagrammatic illustration of a heat pump installation embodying the invention of this application.

Referring to FIG. 1, a heat pump installation 10 is shown having a motor-compressor 12 (of the sealed unit type) which compresses a refrigerant therein, the compressed refrigerant being passed from the compressor through output conduit 14 to condenser coil 16. The refrigerant is cooled in the condenser by any conventional means and in certain circumstances, it may be necessary to supply a second coil in intimate heat transfer relationship with the coil 16 to remove heat therefrom. A second coil is a must if the heat pump is installed at some distance from the point where the condenser heat is required.

When the refrigerant has reached the output of coil 16, it will have been cooled sufficiently to become a liquid under the pressure maintained by the compressor and conduit 18 carries the liquid refrigerant to receiver 19 and onto the expansion valve 20. After being allowed to pass through expansion valve 20, the liquid refrigerant becomes a gas and it passes through conduit 22 to the evaporator coil 24. Here the gaseous refrigerant picks up heat from the evaporator coil and in this instance the evaporator coil is provided with a second coil 26 in intimate heat transfer relationship therewith. Coil 26 in this instance is supplying heat to the evaporator coil from a remote heat source (not shown). The heated refrigerant gas thus passes from coil 24 via conduit 30 to compressor 12.

In order for this invention to function, it is necessary that coil 26 be provided to supply heat to the evaporator coil. Coil 26 will have a heat transfer fluid circulating therein; this fluid may be water, ethylene glycol, or a brine solution, the heat transfer fluid being pumped through coil 26 by pump 32.

In addition to pumping the heat transfer fluid through coil 26, additional smaller heat reclaiming conduit 34 is provided to bleed a small portion of the heat transfer fluid from the main line 36. The conduit 34 is then connected to the condenser to preheat the heat transfer fluid slightly, thence the conduit 34 is shown encircling the compressor shell 12, then the reclaiming conduit passes in intimate heat transfer relationship with conduit 14 as shown.

The reclaiming circuit will pick up heat from the condenser 16, the compressor shell 12 and the output conduit 14. The heated fluid is thence returned via conduit 40 to the conduit 42 which conduit feeds pump 32 with heat transfer fluid from a heat source (not shown). Pump 32 thus forces the heat transfer fluid through the two circuits, i.e. the main circuit comprising the coil 26 and the heat source, and the heat reclaiming circuit comprising small conduits 34 and 40. A control valve 44 may be necessary to control the flow of heat transfer fluid in the heat reclaiming circuit.

The ratio of fluid flow between the two circuits will probably be in the order of 100:1, thus most of the heat returned by conduit 40 to conduit 42 will be dissipated in coil 26 with an insignificant portion being returned to conduit 34 for a return trip through the reclaiming circuit.

FIG. 1 shows the reclaiming conduit diagrammatically and the reclaiming circuit is designed in such a manner that the majority of heat reclaimed is from the compressor shell. To this end, the heat transfer device of FIG. 2 is fitted to the compressor shell.

Figure 2:
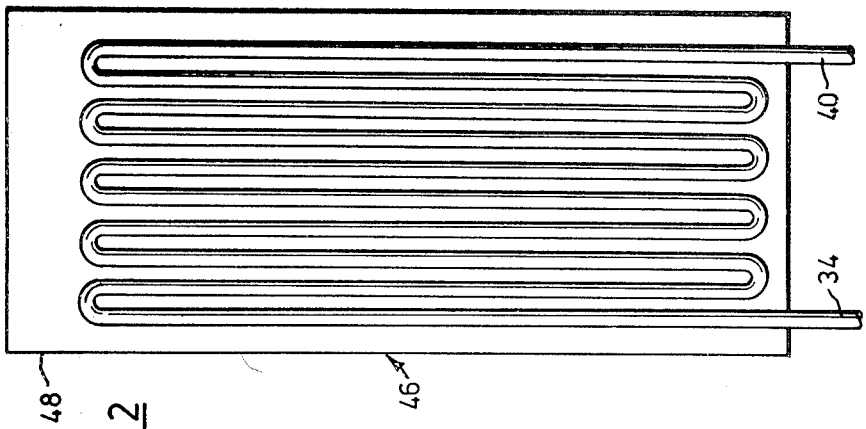
FIG. 2 shows a heat transfer sleeve and associated conduit used to absorb compressor heat.

FIG. 2 shows a compressor heat reclaiming device 46 comprising sheet 48 of heat absorbing material such as copper or aluminum to which the conduit of the reclaiming circuit is attached in good heat transfer relationship. The sheet 46 is wrapped around the compressor shell to absorb heat therefrom. Various clamping methods may be used to assure good heat transfer from the compressor shell to the sheet 46, but it is not deemed necessary to describe them here.

Also, only one type of device 46 is shown, but it will be appreciated that other types of heat transfer devices such as the inflated conduit type commonly used in cold plate evaporators in domestic refrigerators may be used as alternatives to the one illustrated in FIG. 2.

Care must be taken to assure that the correct amount of heat is absorbed from the compressor shell. If too much heat is absorbed from the compressor shell, poor operation of the compressor is likely to occur. It is desirable to absorb the maximum amount of heat from the compressor without impairing operation. It has been found that by absorbing some heat from the condenser that the heat transfer fluid is preheated slightly, and the temperature of the reclaiming device 46 tends to be more uniform, thus avoiding any exceptionally "cold" areas on device 46, thus preventing excessive cooling of certain areas of the compressor, and the associated problems in operation of the compressor operation as a result of excessive temperature differences in the shell of the compressor. The heat absorbed by reclaiming circuit 34 from tube 14 which is the hottest part of the condenser circuit is a bonus.

The reclaiming circuit provides an improved C.O.P. for the heat pump installation shown, because the heat dissipated by the compressor shell to the surrounding medium is to a large extent captured by the heat reclaiming device 48 and returned to the heat pump through transfer to evaporator coil 24 from coil 26.

The lowering of the operating temperature of the compressor will lead to improved compressor operation and an increase in compressor life.

Although the description has been directed to a sealed unit type motor-compressor 12, it will be understood that once this circuit has been divulged, it would be but expected skill of one skilled in the art to apply the reclaiming circuit to a heat pump having a separate motor and compressor.

The embodiments of the invention in which an exclusive property or privilege is claimed are defined as follows:

1. A heat reclaiming device for the recovery of waste heat in the region of the compressor of a heat pump installation comprising a refrigerant compressor housed in a cover shell, refrigerant condenser, refrigerant evaporator, an expansion valve, and a receiver and conduit connecting said compressor, condenser, expansion valve, evaporator, and receiver in operating relationship, said installation having a second heat transfer coil in good heat transfer relationship with said evaporator, said second heat transfer coil having a heat transfer fluid circulating through a secondary circuit comprising a heat source and said second coil, said heat transfer fluid being propelled by pump means, heat reclaiming conduit means connected into said secondary circuit in such manner as to circulate heat transfer fluid therethrough, said heat reclaiming conduit being in good heat transfer relationship with the shell of said compressor, said heat transfer fluid circulating in said heat reclaiming circuit capturing heat given off by the operation of said compressor, said heat reclaiming conduit means connected into said secondary circuit so as to return heat transfer fluid heated by said compressor to said second heat transfer coil.

* * * * *